US005085491A

United States Patent [19]

Lautenschläger

[11] Patent Number: 5,085,491

[45] Date of Patent: Feb. 4, 1992

[54] MOUNTING PLATE ASSEMBLY FOR CABINET HINGES

[75] Inventor: Karl Lautenschläger, Reinheim, Fed. Rep. of Germany

[73] Assignee: Karl Lautenschläger GmbH & Co. KG, Reinheim, Fed. Rep. of Germany

[21] Appl. No.: 392,955

[22] PCT Filed: Nov. 17, 1988

[86] PCT No.: PCT/EP88/01044

§ 371 Date: Jun. 29, 1990

§ 102(e) Date: Jun. 29, 1990

[87] PCT Pub. No.: WO89/05387

PCT Pub. Date: Jun. 15, 1989

[30] Foreign Application Priority Data

Dec. 9, 1987 [DE] Fed. Rep. of Germany ..... 3741686
Feb. 9, 1988 [DE] Fed. Rep. of Germany ..... 3803830
Jun. 1, 1988 [DE] Fed. Rep. of Germany ..... 3818649

[51] Int. Cl.[5] ..... A41F 11/00
[52] U.S. Cl. ..... 312/329; 24/582
[58] Field of Search ..... 312/326-329, 312/319; 24/582, 583, 584

[56] References Cited

U.S. PATENT DOCUMENTS 812,661 2/1906 Luckhaupt ..... 24/583
833,458 10/1906 Hausherr ..... 24/583

*Primary Examiner*—Joseph Falk

[57] ABSTRACT

Mounting plate assembly (30) for the mounting of a hinge on a wall of a cabinet, which has two separable mounting plates (40; 42) which are superimposed on one another and can be snapped on and off from one another. The bottom mounting plate (40) which can be fastened to the wall of the cabinet has at its front end pointing away from the cabinet interior at least one hook projection (78) with which a hook recess (76) on the underside of the upper mounting plate is associated.

The catch mechanism for the releasable joining of the two mounting plates (40; 42) has on the upper mounting plate (42) two parallel bows (64) which can be flexed [parallel?] to the cabinet wall, each having a catch section (74), the catch sections being matingly engaged each with an associated catch recess (80) in the bottom mounting plate (40).

By exerting a contrarily directed pressure parallel to the cabinet wall the catch sections (74) can be brought out of engagement with the catch recess (80).

28 Claims, 10 Drawing Sheets

Fig.9
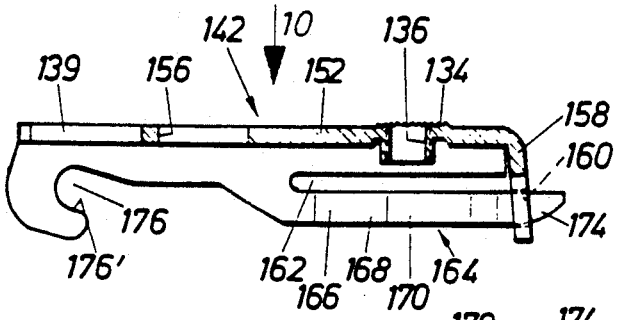
Fig.11
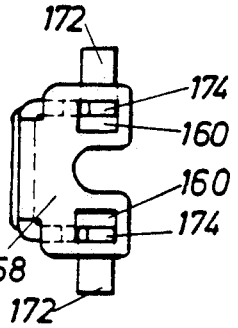
Fig.10
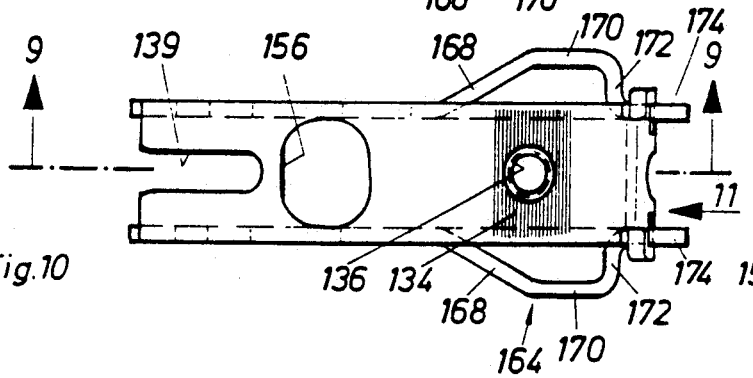
Fig.12
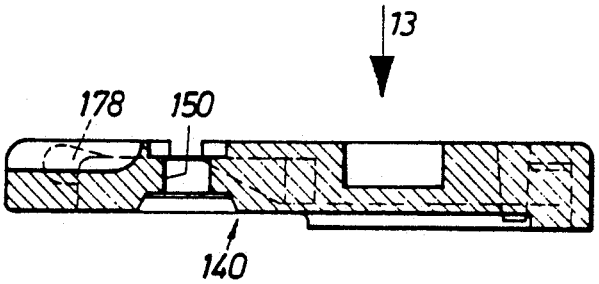
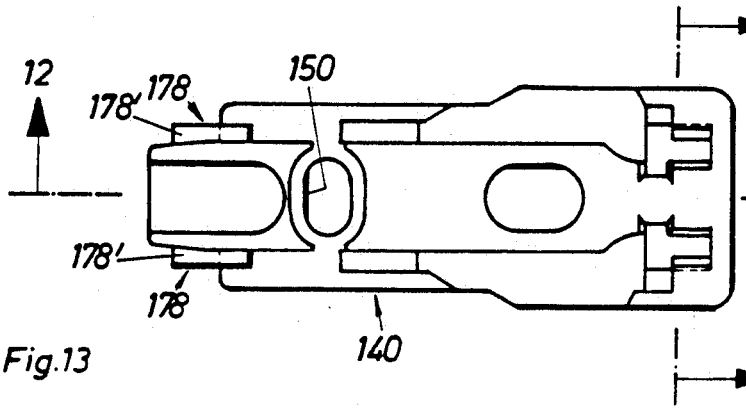
Fig.13
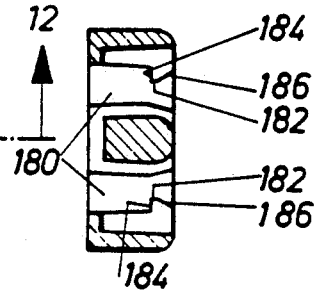
Fig.14

Fig. 15
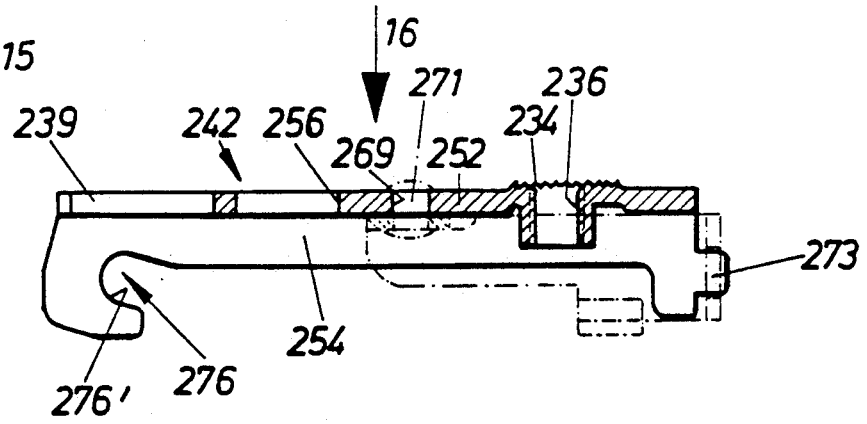
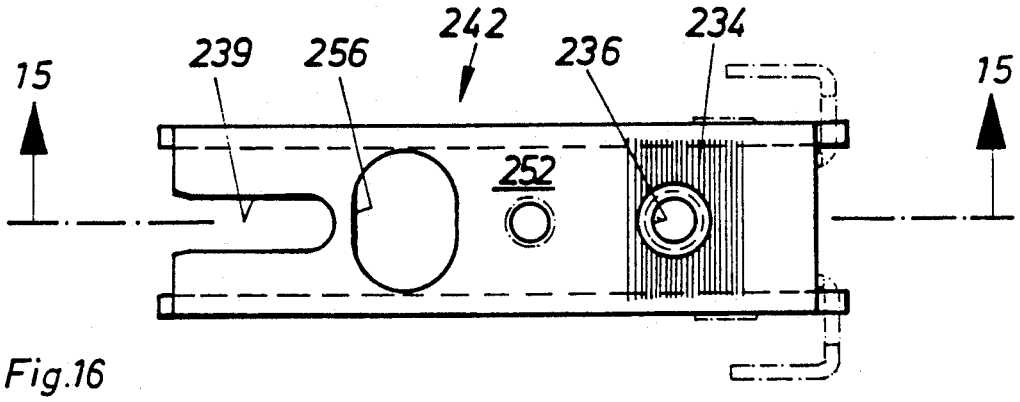
Fig.16
Fig.19
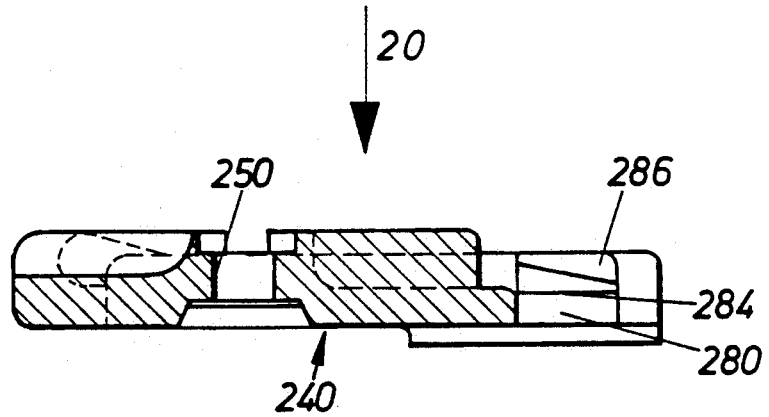
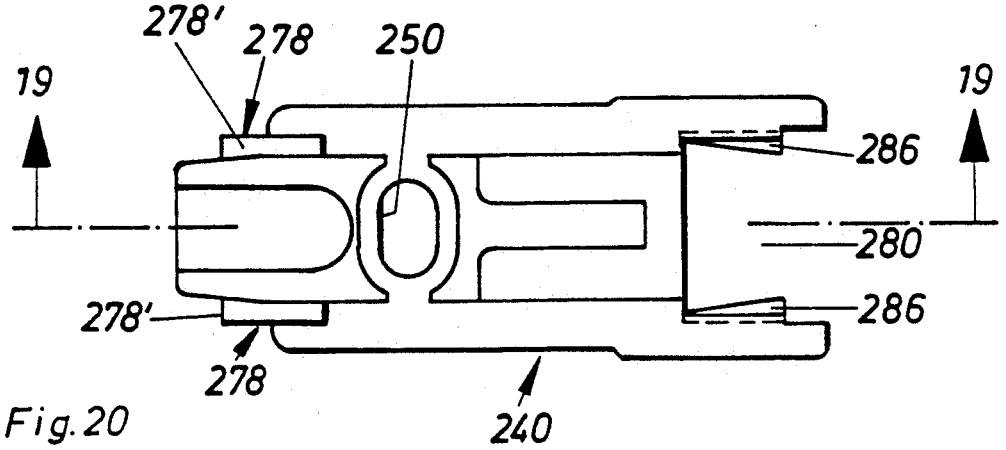
Fig.20

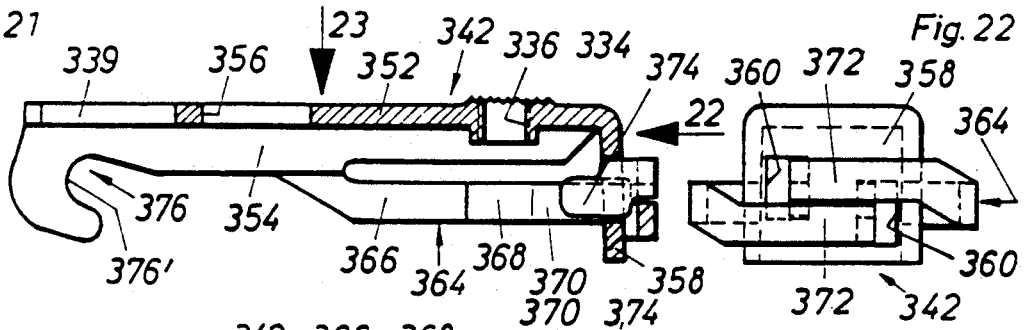
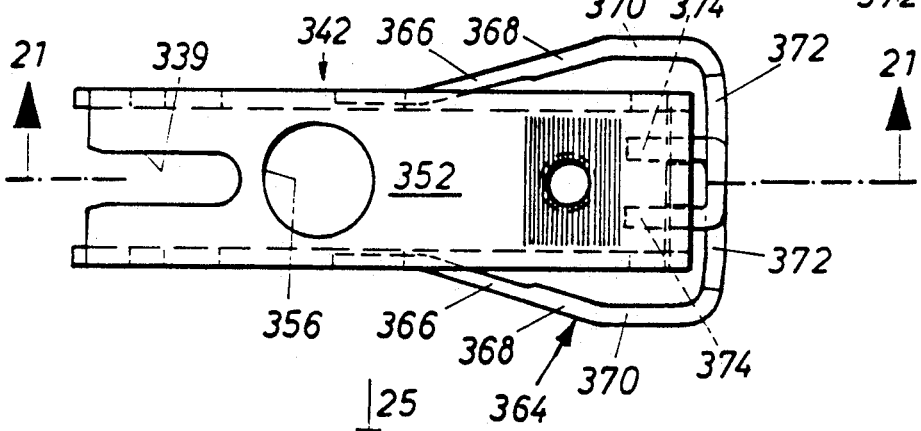
Fig.23
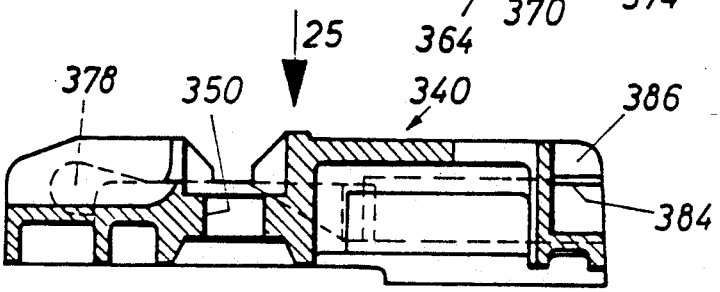
Fig.24
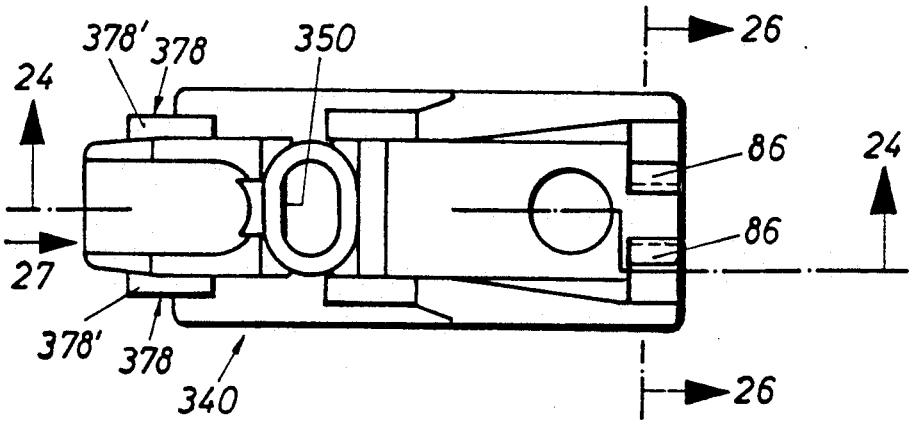
Fig.25
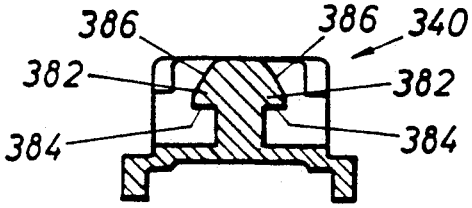
Fig.26
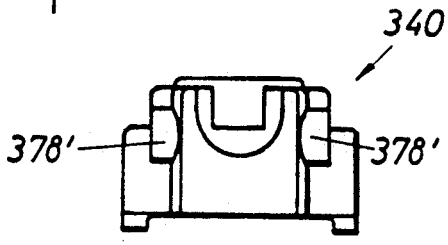
Fig.27

MOUNTING PLATE ASSEMBLY FOR CABINET HINGES

The invention relates to a mounting plate assembly for the adjustable mounting of the wall-related part of a cabinet hinge, which is composed of two separable mounting plates of which the bottom mounting plate closer to the wall can be affixed to the cabinet wall, and the upper mounting plate, more remote from the wall, and holding the carcase-related hinge part adjustably, can be fastened by a resilient catch mechanism to the bottom mounting plate. The bottom mounting plate has at its forward end adjacent the door at least one hook reaching outwardly from the cabinet interior, with which a recess on the underside of the upper mounting plate is associated, the confronting engaging surfaces of the hook and recess being complementary and of an approximately arcuate configuration, at least in part, and the resilient catch mechanism being provided with a handle for releasing the catch holding the mounting plates together.

In hinges mounted with such mounting plates on the wall of a cabinet it is possible to remove individual hinges successively from the cabinet wall or fasten them thereto without the need for difficult manipulations, by actuating the catch mechanism and then raising the arm of the hinge together with the upper mounting plate joined thereto. This is advantageous especially in he case of high cabinets in which the doors are hung on the carcase of the cabinet with more than two hinges, because the doors can then be dismounted—and remounted—even single-handedly. The catch mechanism of the known hinge is formed by a slide guided in the bottom mounting plate and biased by a spring to the catching position; this slide has a catch projection having an inclined catch surface which is held resiliently in engagement with a matching inclined catch surface on the upper mounting plate. The slide is operated by means of a handle which is disposed on the rearward prolongation of the slide toward the cabinet interior. The catch mechanism has been thoroughly proven, but it is of relatively complex construction and accordingly it is expensive. The handle provided on the inner end of the mounting plate is operated by exerting an unlocking movement on the handle outwardly from the cabinet interior. Now, it is not entirely impossible that, when a cabinet is packed very full, the handle may be forced accidentally in the unlocking direction when the door is closed, if, for example, the handle comes in contact with a protruding clothes hanger or other protruding object before the door is fully closed. In the most unfavorable case this might result in the unlocking of the hinge in question and the dropping of the door if the door is hung on the cabinet with only two hinges.

Accordingly, it is the purpose of the invention to make the catch mechanism acting between the top and bottom mounting plates much simpler than the catch mechanism of the known hinge, and at the same time to assure that accidental release will be impossible under any circumstances.

Setting out from a mounting plate of the kind described above, this purpose is accomplished in accordance with the invention by the fact that the upper mounting plate partially hooks onto the bottom mounting plate at least at its end pointing into the cabinet, and is provided in the hooking area with two bows which can flex resiliently parallel to the surface of the cabinet wall and which have each a catch section which matingly catches in an associated recess in the bottom mounting plate. The catch sections and recesses, however, can be brought out of engagement by flexing the bows against one another, parallel to the cabinet wall surfaces. Each bow has a handle that is accessible in the engaged state of the two mounting plates for the purpose of pinching them together in a direction parallel to the cabinet wall surface. The desired simplification of the construction of the catch mechanism is achieved in the resilient bows themselves, so that a precision-made separate actuating slide to be disposed in a fitted guide in the bottom mounting plate is unnecessary.

Since two bows are provided and therefore both of the catch sections have to be forced out of the corresponding recesses in the bottom mounting plate before it will be possible to separate the top from the bottom mounting plate, and since this requires that the bows be squeezed against each other, any unintentional unfastening is impossible. Even if in closing the door one of the handles collides with an object which exerts an unlocking pressure on the bow as the door continues to close, only one of the catch sections will be displaced to the unlocked position, while the second catch section will reliably continue to hold the two mounting plates against separation from one another. As a result of the arrangement of the bows and thus of the handles on the upper mounting plate, the handles can be used not only for unfastening the upper mounting plate from the lower but also, after an unfastening, they can also be used for swinging the upper mounting plate upward along with the hinge arm fastened thereon, without having to pry them up.

In a preferred further development of the invention, the upper mounting plate has an inverted U-shaped cross section with an elongated web and flanges at least partially straddling the sides of the lower mounting plate, the two resilient bows then being fastened at their front end—the end pointing to the outside of the cabinet interior—to the upper mounting plate, and being shaped in their springing area toward the cabinet interior such that they project at least in sections beyond the boundary of the upper mounting plate to form the handles, a clearance existing between the confronting inside faces of the resilient bows and the surfaces of the mounting plates facing them, which permits the horizontal flexing of the bows against one another by the amount necessary for releasing. The handles to be grasped and squeezed together to actuate the release mechanism are thus formed by sections of the resilient bows themselves, which signifies an additional simplification of the catch mechanism.

The resilient bows can be made separately and can be elongated strap-like sections of spring metal joined to the upper mounting plate. Alternatively and preferentially, however, they are in the form of integral strap-like sections cut from the material of the upper mounting plate, thus also eliminating the assembly of separately made bows with the upper mounting plate.

In order to make the integral bows cut from the material of the upper mounting plate resiliently flexible as desired, it is desirable that they have a reduced thickness directly at the area of transition into the upper mounting plate. These areas of reduced thickness than have a reduced resistance to resilient flexure, while the bows have a greater resistance to flexure in the rest of their area of greater material thickness, i.e., they are relatively stiff.

In a preferred embodiment of the invention the resilient bows are formed by cuts made in the flanges of the mounting plate from the cabinet-interior end.

The catch recesses provided in the bottom mounting plate can best have openings on the side facing the upper mounting plate for the introduction of the catch sections provided on the resilient bows, the insertion openings and/or the catch sections being provided with at least one ramp surface that forces the associated catch section resiliently in the release direction when it is inserted, and, next in the direction of insertion, an undercut under which the catch sections snap back together when the two mounting plates arrive at the proper attaching position.

After the area in which the resilient bows are joined to the upper mounting plate, or at their transition to their associated lateral flanges of the upper mounting plate, the bows can be divided into a plurality of angled segments of which the first is bent outwardly at an angle toward the cabinet-interior end of the mounting plate, and the adjoining section, which forms the handle, is bent back to a position parallel to the longitudinal axis of the mounting plate, and the next section of the bow can be bent at about right angles to the longitudinal axis, followed by the end section forming the actual catch, which is bent back again to a position approximately parallel to the longitudinal axis.

In order to make the locking engagement of the catch portions of the bows in the recesses in the bottom mounting plate as tight as possible in the disassembly direction, i.e., at right angles to the cabinet wall, provision is made in an advantageous further development of the invention for the resilient bows to be guided in the vicinity of the catch through a window-like opening in a wall of the upper mounting plate, whose free height measured at right angles to the cabinet wall is approximately equal to or only slightly greater than the height of the bow in the area passing through the opening, while its width measured in the direction of actuation of the bow corresponds to the bow movement that is necessary for release. The guidance of the bow in the window-like opening prevents any displacement of the bow relative to the upper mounting plate at right angles to the cabinet wall, while on the other hand the flexing of the bows parallel to the wall as necessary for release is possible within the width of the window-like openings. At the same time the openings also act as lateral abutments for the bows, so that it is not possible to bend the bows beyond the amount necessary and predetermined for release. If due to production inaccuracies one of the bows should have less spring bias than the others, the abutment action of the window-like opening furthermore assures that both bows, i.e., also the bow with the greater spring bias, will be fully released, because after the first bow of lesser bias contacts the edge of the window-like opening forming the abutment no further bending of this bow is possible and any continued releasing force will then be used exclusively for bending the second bow of the stronger spring bias.

If the resilient bows are made separately and are elongated, strap-like sections of spring metal joined to the upper mounting plate, a configuration is practical in which the resilient bows are disposed within the flanges of the upper mounting plate and are brought out of its cabinet-interior end, in which case their catch sections are formed by outwardly bent projections which can catch on undercuts provided on the bottom mounting plate in the area lying within the upper mounting plate, and the ends of the bows brought out of the cabinet-interior end are bent once at about right angles away from one another and then again forward at about right angles to form the handle, and in which a window-like opening is provided in the bent-apart sections, which is entered by a projection reaching from the flanges of the upper mounting plate toward the cabinet interior, window-like openings being approximately equal height or only slightly higher than the height of the associated flange projection, while their width corresponds to the amount of bow movement necessary for the release of the catch.

The two resilient bows can be bent away at right angles from a cross member uniting them at their outer end, this cross member being fastened to the inside of the web of the upper mounting plate, preferably by riveting it to the said web. As compared with fastening separate bows to the flanges of the upper mounting plate, this reduces the complexity of assembly.

Furthermore, embodiments of the mounting plate in accordance with the invention can be made in which the snap-fastening of the upper mounting plate on the bottom mounting plate is accomplished by the displacement of the catch sections parallel to the long axis of the mounting plate, although the release of the catch is again produced by a displacement of the bows at right angles to the long axis, i.e., transversely of the bows. This is accomplished by the fact that the catch recesses are formed by a groove-like recess provided parallel to the cabinet wall and transversely of the long axis of the mounting plate assembly in the rearward end wall of the bottom mounting plate facing the interior of the cabinet, and by the fact that the resilient bows are carried beyond the rearward end wall of the bottom mounting plate into the cabinet interior, and then are bent back to the end wall of the bottom mounting plate such that their free end sections, which form the catches, engage the groove-like recess in the bottom mounting plate when in the locked position.

It is then advantageous if the bottom mounting plate is provided at its cabinet-interior end, on its upper side facing the upper mounting plate, with a ramp surface running transversely of the long axis of the mounting plate, which is engaged by the catches when the upper mounting plate is snapped onto the bottom mounting plate, and the catches are displaced resiliently toward the cabinet interior such that their free ends pass over the end wall of the bottom mounting plate until they snap into the groove-like recess.

At the same time, a configuration is possible in which the resilient bows are bent back toward the bottom mounting plate in the area of the cabinet-interior end, and adjoining this bend they have a section supported on the side of the bottom mounting plate and extending in back of the rearward end wall of the bottom mounting plate, from whose cabinet-interior ends a section reaching behind the end wall is bent, from which again the end section forming the catch is bent back toward the end wall. In the mounting plate thus constructed, when the bows are squeezed together the fact that the sections of the bows that extend in back of the end wall are supported against the side walls of the bottom mounting plate produces a displacement of the sections bent behind the end wall in the direction of the cabinet interior, plus a simultaneous turning, such that the catch sections come free from the transversely disposed, groove-like recess and the catch is thus released.

Alternatively, the configuration can also be such that the resilient bows diverge at an angle rearwardly into the cabinet interior from the area wherein they are fastened on the upper mounting plate and have sections reaching beyond the rearward end wall of the bottom mounting plate into the cabinet interior, which are followed by bow sections that are bent back to a point in back of the end wall, followed by end sections forming the catch sections which are spaced apart and parallel, and also such that, approximately in the center of the cabinet-interior end of the bottom mounting plate, an opening facing the cabinet interior is provided extending from its top to the groove-like recess, whose width measured transversely of the long axis is smaller than the lateral distance between the catch sections, but at least slightly greater than twice the thickness of the material of the catch sections.

The end sections of the bows, which constitute the catch sections, are provided, in the area coming in contact when the upper mounting plate is snapped onto the bottom mounting plate, with a ramp surface inclined at an angle complementary to the ramp on the bottom mounting plate.

To prevent the catch sections from bending at right angles to the cabinet wall when the upper mounting plate is placed on the bottom mounting plate, it is furthermore recommendable to pass the resilient bows in the area of the catch section through a window-like opening in a wall of the upper mounting plate which overlaps the end wall of the bottom mounting plate. The height of the opening, measured at right angles to the wall, will be approximately equal to or only slightly greater than the height of the tongues in the area that passes through the opening, while its width measured in the direction in which the bows are moved to separate the plates is at least large enough to permit the bow sections passing through the opening to freely perform the movement parallel to the wall that is needed for the release.

If the mounting plates described above are to be developed such that a door hung on the carcase of a cabinet [can be removed] not only in the manner described, by unsnapping the cabinet-interior end of the upper mounting plate from the bottom plate and then rocking the hinge arm upward, but also [by] any other separating movement, as for example a removal of the upper mounting part from the bottom part parallel to the cabinet wall, this can be accomplished in a further development in accordance with the invention by providing two projecting hooks each forming an additional catch recess at the front, door-end portion of the bottom mounting plate, while the associated hooks on the upper mounting plate are formed by additional bows which can flex resiliently parallel to the cabinet wall, and which have each a catch section matingly engaged in its associated catch recess, but the catch sections and recesses can be brought out of engagement by bending the additional bows against one another parallel to the wall, and each bow has additional handles which can be accessed when the two mounting plates are snapped together, for the purpose of squeezing them together in a direction parallel to the wall. With the mounting plate thus constructed, disassembly can then be performed either in the manner heretofore commonly practiced by unsnapping the cabinet-interior ends of the two mounting plates and then rocking upwardly, or by simultaneously unsnapping the upper mounting plate from the bottom mounting plate at both ends, whereupon the upper mounting plate can be removed from the bottom mounting plate by any desired movement. This is important especially when the mounting plate in accordance with the invention is to be used in conjunction with hinges of different joint mechanisms whose movements are very different. It would then be conceivable that a mounting plate adapted to a particular hinge as regards the configuration of the engaging surfaces of the hooks and hook recesses would not be usable with a hinge of a different kind of motion because the hinge in question performs a movement different from the necessary rocking movement for unlocking the hooks and hook recesses. In the case of the hinge in accordance with the invention, however, this case is not critical, because the upper mounting plate can perform any desired movement for its removal after the additional unsnapping of the catch mechanism at the door end.

In a preferred further development of the invention, the catch sections formed on the bows provided at the cabinet-interior end of the mounting plate and the corresponding catch recesses, correspond, in a mirror-image relationship on either side of a plane running approximately centrally through the mounting plate parallel to the hinge pivot axis and perpendicular to the cabinet wall, to additional catch sections formed on the bows provided at the front, door end and to the associated additional catch recesses. Thus, since the catch sections and recesses at the cabinet-interior end have arcuate engaging surfaces, it is possible to disengage the upper mounting plate from the bottom mounting plate at the front, door end, and to rock it up about an axis situated in the area of the cabinet-interior end of the mounting plate.

If the upper mounting plate has an inverted U-shaped cross section as seen transversely of its length and its U-shaped side walls matingly overlap the lateral surfaces of the bottom mounting plate, it is recommendable to provide in the side walls of the upper mounting plate a notch in each edge of the side wall in question facing the dividing wall surface, which notch is matingly engaged by a projection extending from the lateral surfaces of the bottom mounting plate. Thus the upper and bottom mounting plates will be additionally and positively secured against accidental displacements lengthwise relative to one another when in the joined state.

At the same time the configuration is preferably made such that the notches expand toward the free edge of the side wall and the projections have a complementary expanding shape. When the upper mounting plate is assembled on the bottom mounting plate, an automatic alignment of the two mounting plates to be joined together will thus be achieved.

If the mounting plate assembly in accordance with the invention additionally is to have the possibility of upward and downward adjustment i.e., adjustment parallel to the pivot axis of a hinge to be mounted therewith, the bottom mounting plate, in further development of the invention, can in turn be divided into a holder that is snap-fastened to the upper mounting plate and a fastening plate which can be affixed to the cabinet wall, the holder being displaceable parallel to the hinge pivot axis and being fixable on the fastening plate in selectable positions. The fastening plate can then be provided with wing-like projections extending in opposite directions from the opposite longitudinal margins of the holder, and bores can be provided to accommodate the shaft of mounting screws. The mounting plate then is in the form of a "wing plate" that is adjustable in height. The distance between the bores in the wing-like projections is then made such as to correspond to the spacing of rows of bores provided in the walls of cabinet to accommodate shelf holders or the like. A spacing commonly used today in the furniture industry for the bores in such rows is, for example, 32 millimeters.

The invention will be further explained in the following description of several embodiments, in conjunction with the drawings, wherein:

FIG. 9 is a section through the upper plate of a second embodiment of the mounting plate assembly according to the invention, taken in the plane defined by arrows 9—9 in FIG. 10.

FIG. 10 is a top view of the upper mounting plate, seen in the direction of arrow 10 in FIG. 9.

FIG. 11 is a view of the cabinet-interior end of the upper mounting plate, seen in the direction of arrow 11 in FIG. 10.

FIG. 12 is a section taken through the lower plate of the second embodiment of the mounting plate assembly of the invention, in the plane defined by arrows 12—12 in FIG. 13.

FIG. 13 is a top view of the lower plate as seen in the direction of arrow 13 in FIG. 12.

FIG. 14 is a cross section seen in the direction of the arrows 14—14 in FIG. 13.

FIG. 15 is a section through the upper plate of a third embodiment of the mounting plate assembly of the invention, taken in the plane defined by the arrows 15—15 in FIG. 16, the position of the resilient bows made separately in this embodiment being represented in dash-dotted lines.

FIG. 16 is a top view of the upper mounting plate as seen in the direction of arrow 16 in FIG. 15.

Figure 1:
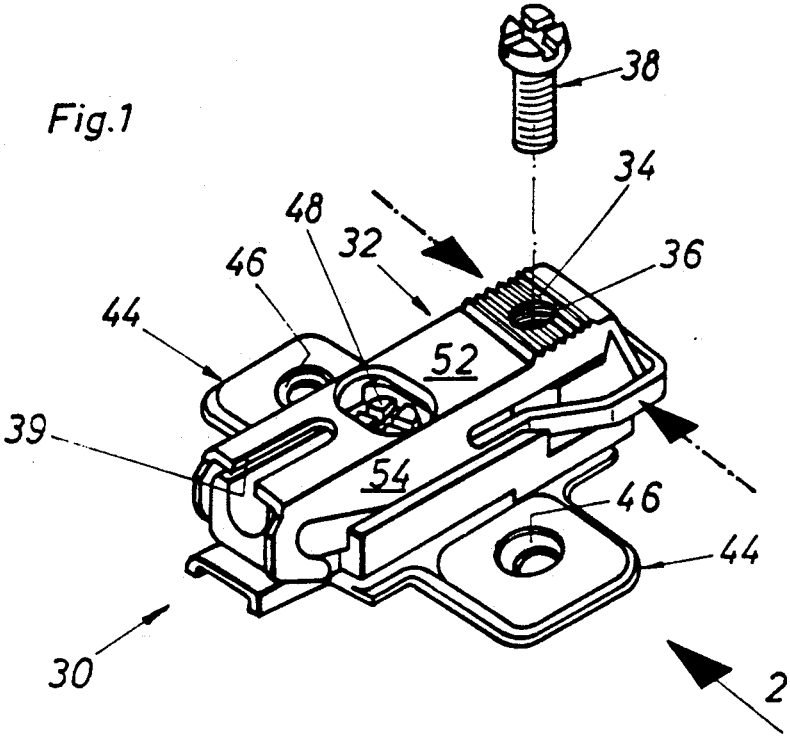
FIG. 1 is a perspective view of a first embodiment of the mounting plate assembly constructed in the manner of the invention.

FIG. 19 a section through the lower plate of the third embodiment, taken in the plane defined by the arrows 19—19 in FIG. 20.

FIG. 20 a top view of the lower mounting plate as seen in the direction of arrow 20 in FIG. 19.

FIG. 21 is a section taken in the plane defined by arrows 21—21 in FIG. 23 through the upper plate of a fourth embodiment of the mounting plate assembly according to the invention;

FIG. 22 is a view of the upper mounting plate, seen in the direction of arrow 22 in FIG. 21.

FIG. 23 is a top view of the upper mounting plate, seen in the direction of arrow 23 in FIG. 21.

FIG. 24 is a section through the lower plate of the fourth embodiment in the plane defined by the arrows 24—24 in FIG. 25.

FIG. 25 is a top view of the lower mounting plate as seen in the direction of arrow 25 in FIG. 24.

FIG. 26 is a cross section seen in the direction of arrow 27 in FIG. 25.

FIG. 27 is a front view of the lower mounting plate seen in the direction of arrow 27 in FIG. 25.

Figure 28:
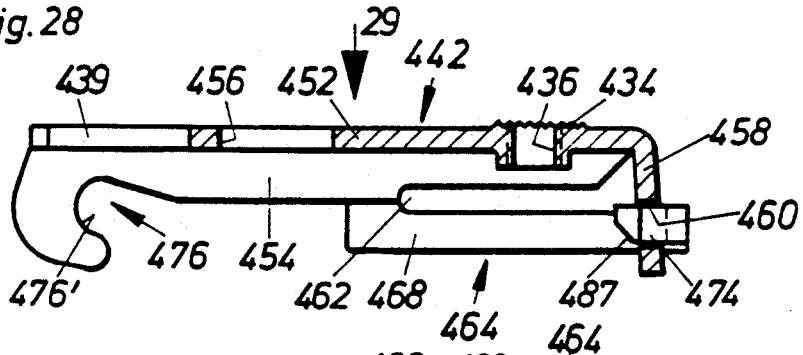
Figure 29:
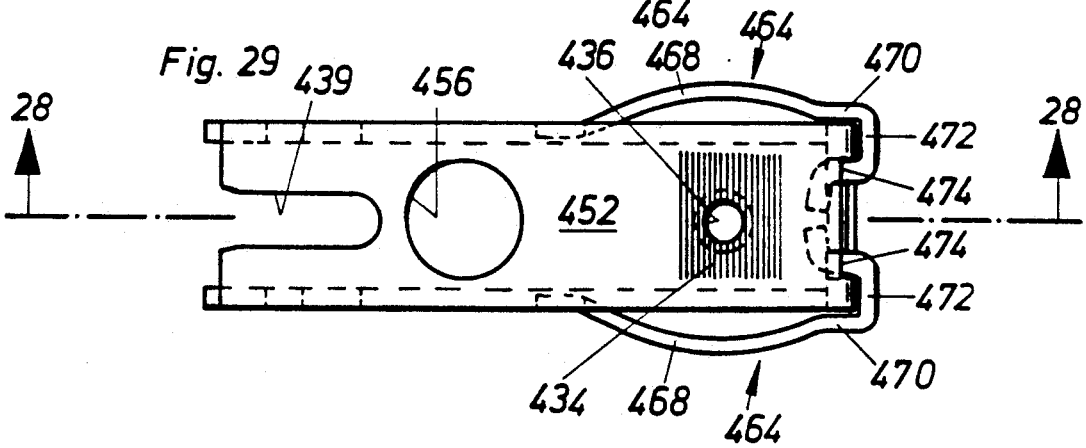

FIG. 28 is a section through the upper mounting plate of a fifth embodiment of the mounting plate assembly according to the invention, in the plane defined by the arrows 28—28 in FIG. 29.

FIG. 29 is a top view of the upper mounting plate, seen in the direction of arrow 29 in FIG. 28.

Figure 30:
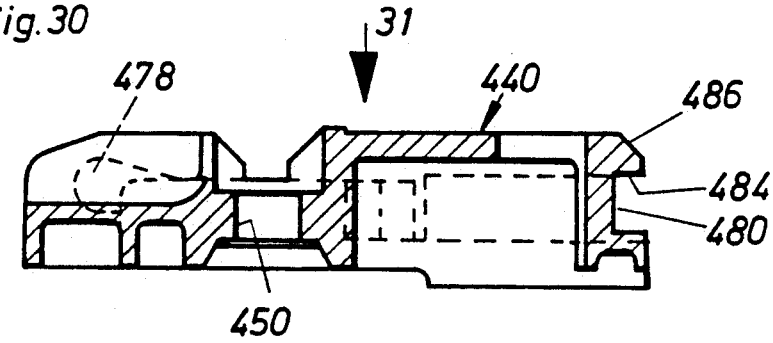
Figure 31:
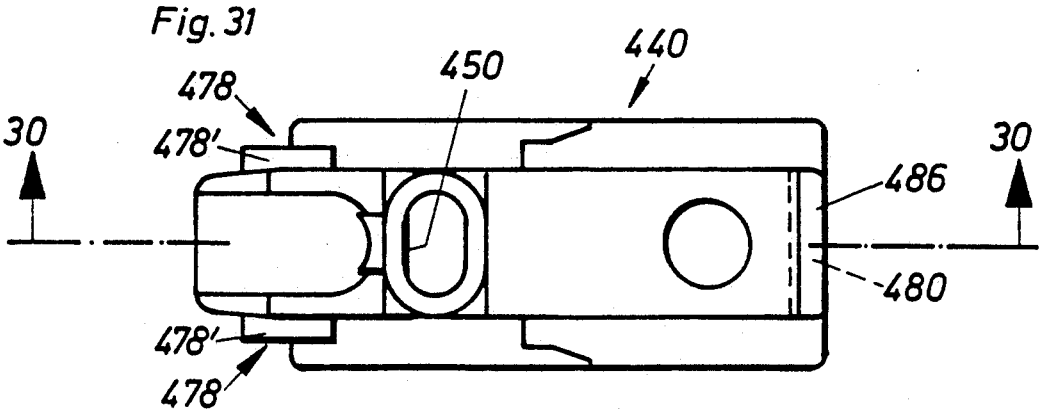

FIG. 30 is a section through the lower mounting plate of the fifth embodiment, in the plane defined by the arrows 30—30 in FIG. 31.

FIG. 31 is a top view of the lower mounting plate seen in the direction of arrow 31 in FIG. 30.

Figure 32:
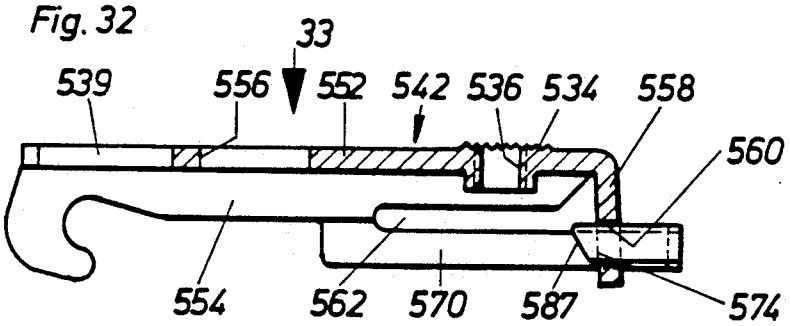
Figure 33:
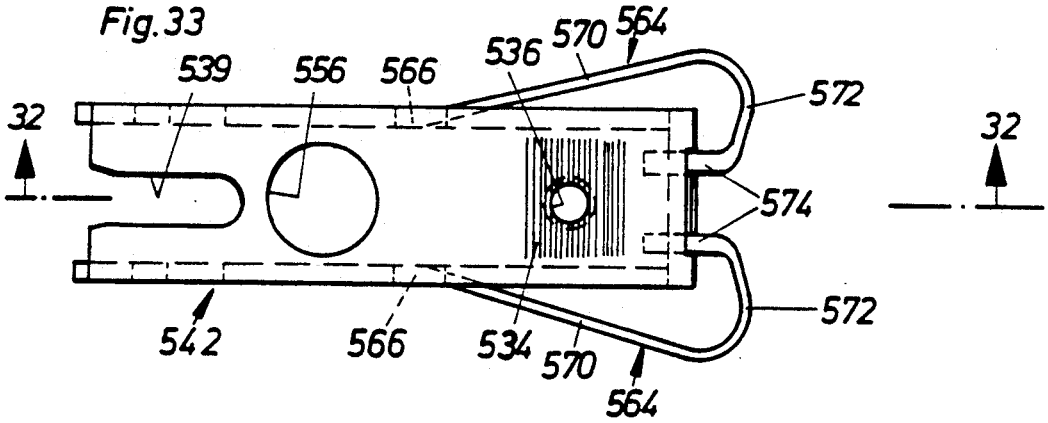

FIG. 32 is a section taken through the upper plate of a sixth embodiment of the mounting plate assembly according to the invention, in the plane defined by arrows 32—32 in FIG. 33.

FIG. 33 is a top view of the upper mounting plate, seen in the direction of arrow 33 in FIG. 32.

Figure 34:
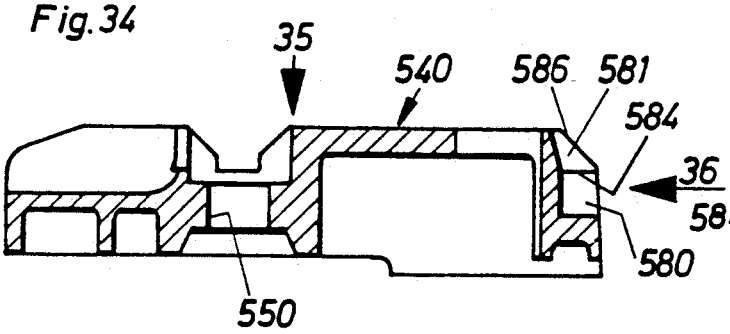
Figure 35:
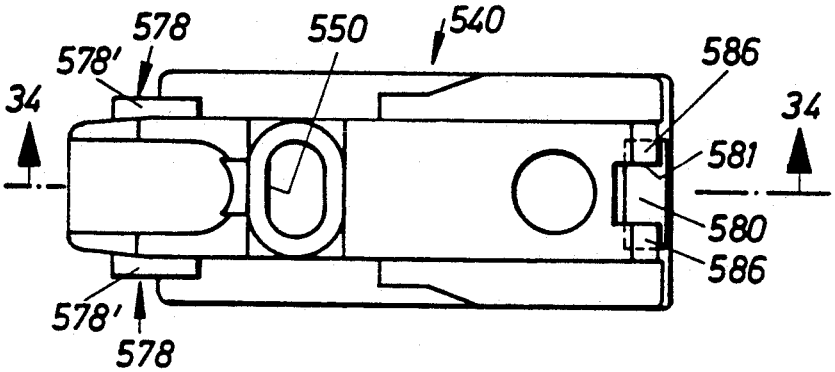

FIG. 34 is a section taken through the plane defined in FIG. 35 through the lower mounting plate of the sixth embodiment.

FIG. 35 is a top view of the bottom mounting plate seen in the direction of arrow 35 in FIG. 34.

Figure 36:
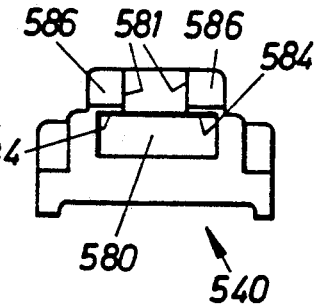

FIG. 36 is a view seen in the direction of arrow 36 in FIG. 34.

Figure 37:
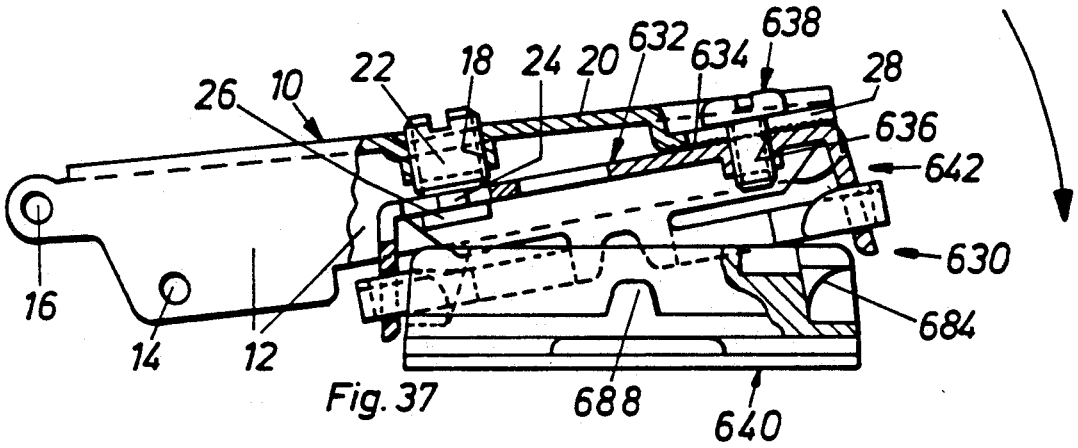

FIG. 37 is a cutaway view partially in section along the longitudinal central axis and partially in phantom of a seventh embodiment of a mounting plate assembly constructed in the manner of the invention, with a hinge arm held on the upper mounting plate, showing a first possibility for the attachment of the upper plate to and its detachment from the bottom plate.

Figure 38:
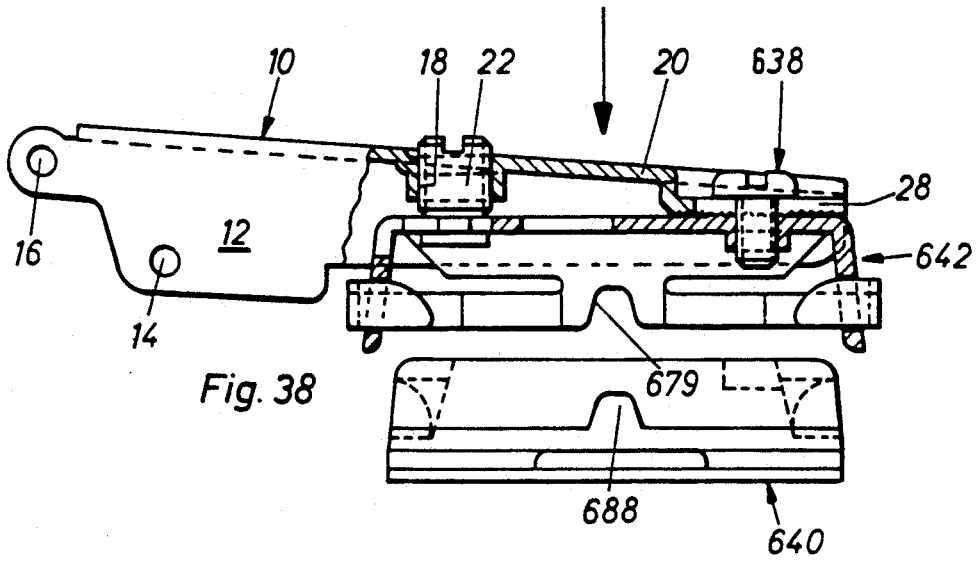

FIG. 38 a view of the mounting plate assembly corresponding to FIG. 37, showing a second possibility for the attachment of the upper plate to and its detachment from the lower plate.

Figure 39:
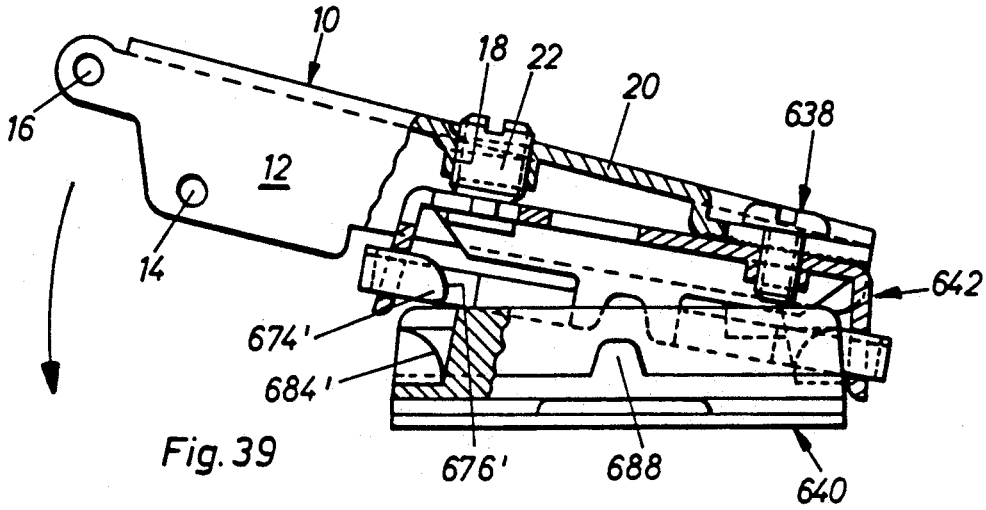

FIG. 39 is a view corresponding to FIGS. 37 and 38, in which a third possibility for attachment and detachment is shown.

Figure 40:
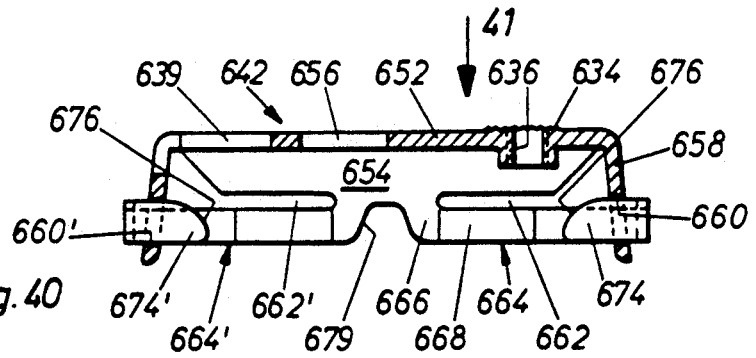
Figure 41:
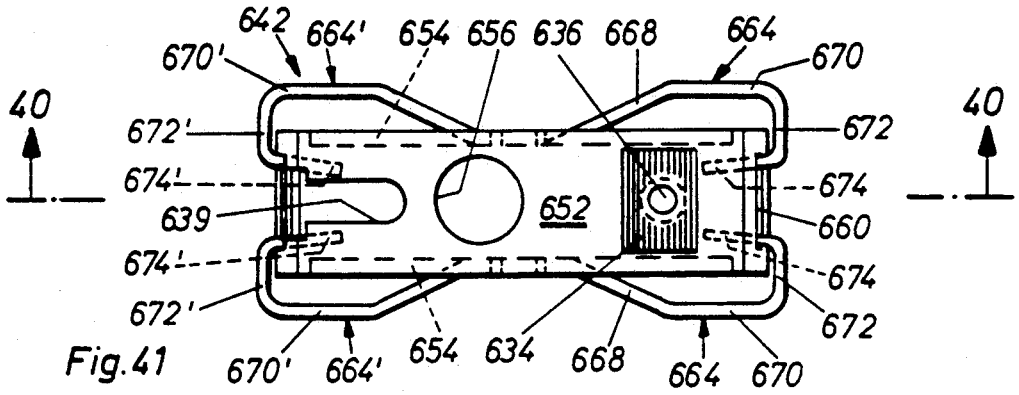

FIG. 40 a sectional view of the upper plate of the mounting plate assembly shown in FIGS. 37 to 39, as seen in the direction of arrows 40—40 in FIG. 41.

FIG. 41 is a top view of the upper mounting plate, seen in the direction of arrow 41 in FIG. 40.

Figure 42:
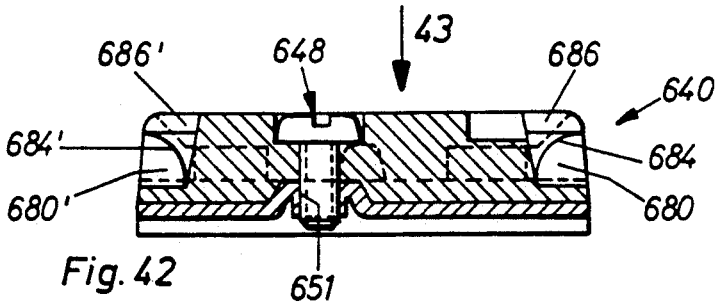
Figure 43:
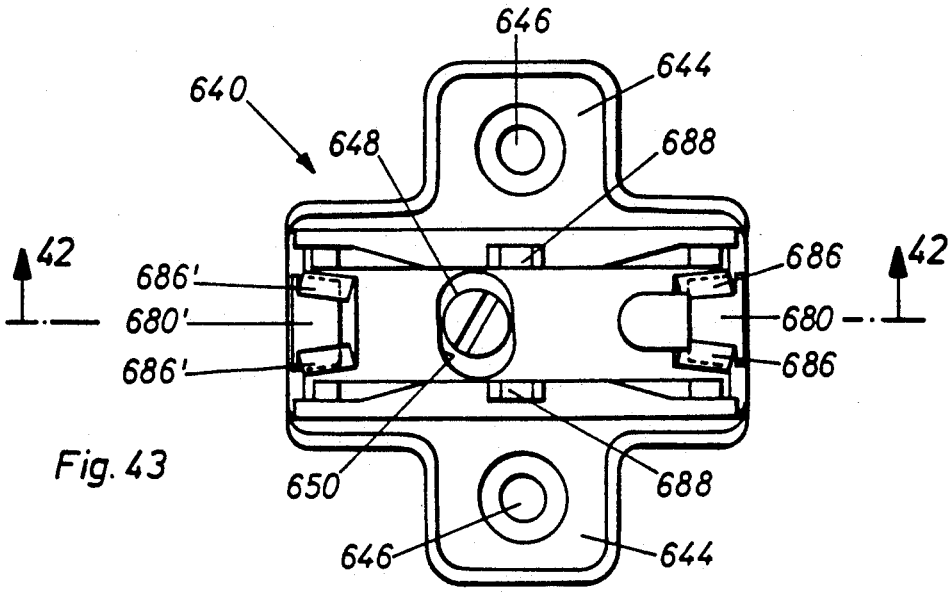

FIG. 42 is a sectional view of the lower plate of the mounting plate assembly shown in FIGS. 37 to 39, as seen in the direction of arrows 42—42 in FIG. 43, and FIG. 43 is a top view of the lower mounting plate as seen in the direction of arrow 43 in FIG. 42.

Figure 2:
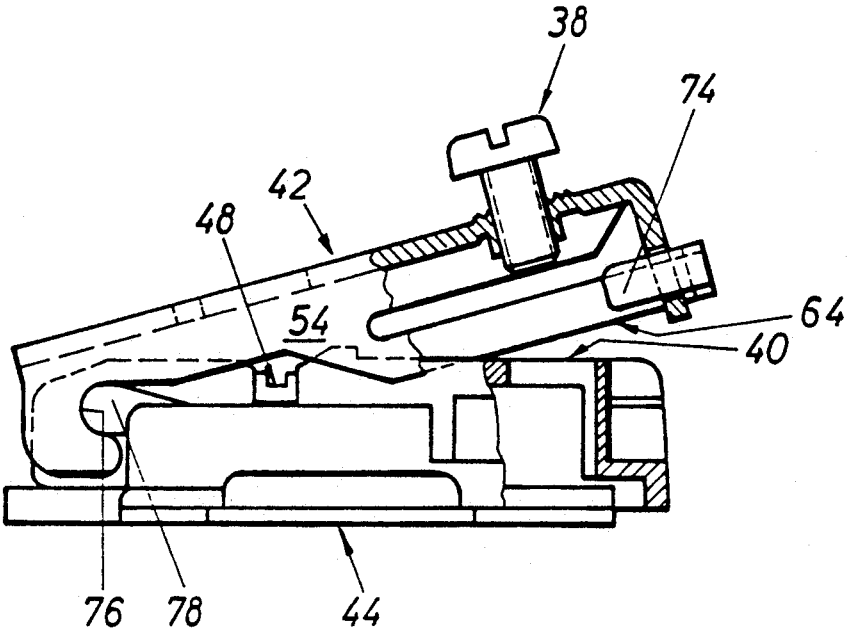
FIG. 2 is a side elevation of the mounting plate assembly of FIG. 1, as seen in the direction of arrow 2 in FIG. 1, the upper mounting plate being represented with one end raised up from the lower mounting plate and the ends of both plates being cut away to show the catch mechanism.

In FIGS. 1 and 2 there is shown a first embodiment, identified as a whole by the number 30, of a mounting plate assembly configured in the manner of the invention, on which can be fastened the wall-related part, in the form of an elongated arm, of an articulated hinge which otherwise corresponds to the state of the art and therefore is not represented. In regard to the configuration of the hinge arm that is to be fastened on the mounting plate assembly 30, suffice it to refer to the configuration of the hinge shown in FIGS. 1 and 2 of DE-OS 35 25 279 and described in the corresponding description.

The mounting plate assembly 30 has an elongated platform 32 in whose rearward end area, i.e., the area facing the cabinet interior, a tap 36 is provided within an area having serrations 34, and a screw 38 serving to fasten the hinge arm can be threaded into the tap. In the front end, i.e., the end pointing out of the cabinet interior, the platform 32 has open-ended slots 39 to accommodate the neck section of a threaded spindle (not shown) for the adjustment of the door overlap.

Figure 5:
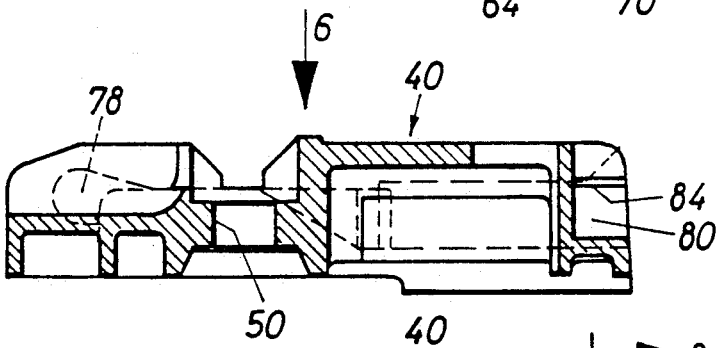
FIG. 5 is a section through the lower mounting plate shown in FIGS. 1 and 2, taken in the plane defined by the arrows 5—5 in FIG. 6.
Figure 6:
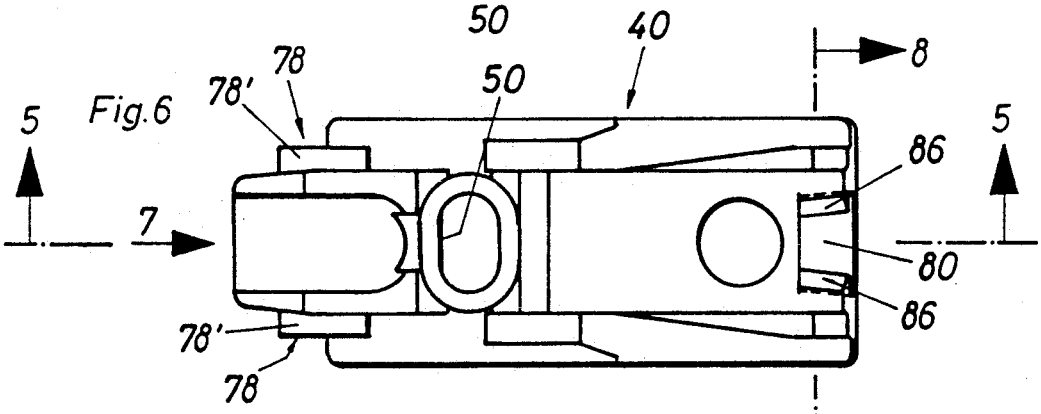
FIG. 6 is a top view of the lower mounting plate as seen in the direction of arrow 6 in FIG. 5.
Figure 8:
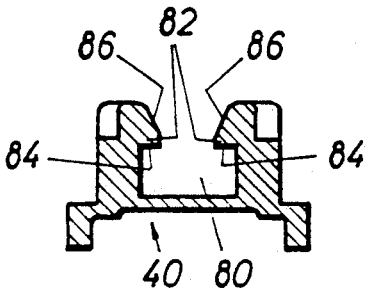
FIG. 8 is a cross section as seen in the direction of arrows 8—8 in FIG. 6.
Figure 7:
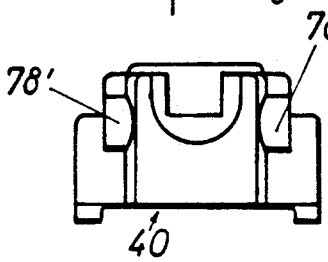
FIG. 7 is a front view of the lower mounting plate as seen in the direction of arrow 7 in FIG. 6.

The actual mounting plate assembly 30 is in two parts and is composed of a lower plate 40 to be fastened directly to the cabinet wall (FIGS. 2 and 5 to 7) and an upper plate 42 (FIGS. 2, 3 and 4) snapped onto the lower plate 40. In the embodiment shown, the mounting plate assembly 30 is in the form of a so-called wing plate in which a wing-like lug 44 projects on opposite sides from the central platform serving for the adjustable fastening of a corresponding hinge arm; these lugs usually serve for fastening the mounting plate assembly to the wall. The upper mounting plate 42, which essentially forms the upper platform 32, is placed upon the lower mounting plate 40 and snapped together with it in the manner to be described below. The lugs 44 are the outer end sections of a separately made integral wing plate lying in a gain in the bottom of the lower mounting plate 40 and screwed to the latter. To fasten the mounting plate assembly 30 on a cabinet wall, screws (not shown) are driven through countersunk openings 46 in the lugs 44 (FIG. 1) into holes in the cabinet wall-related part. The wing plate formed by the lugs 44 and the lower mounting plate 40 are fastened together by a screw 48 (FIGS. 1 and 2) whose shaft is driven through a slot 50 (FIGS. 5 and 6) running transversely of the length of the mounting plate assembly into a tap (not shown) in the wing plate. When the fastening screw 48 is loosened, therefore, it is possible to shift the bottom mounting plate 44 relative to the wing plate by a certain amount within the length of the slot 50, i.e., a hinge mounted on the mounting plate 30 can be adjusted for height.

Figure 3:
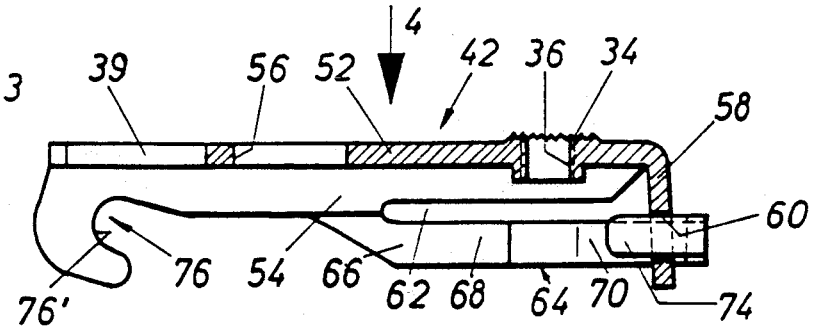
FIG. 3 is a section through the upper plate of the mounting plate assembly shown in FIGS. 1 and 2, which is taken in the plane defined by the arrows 3—3 in FIG. 4.
Figure 4:
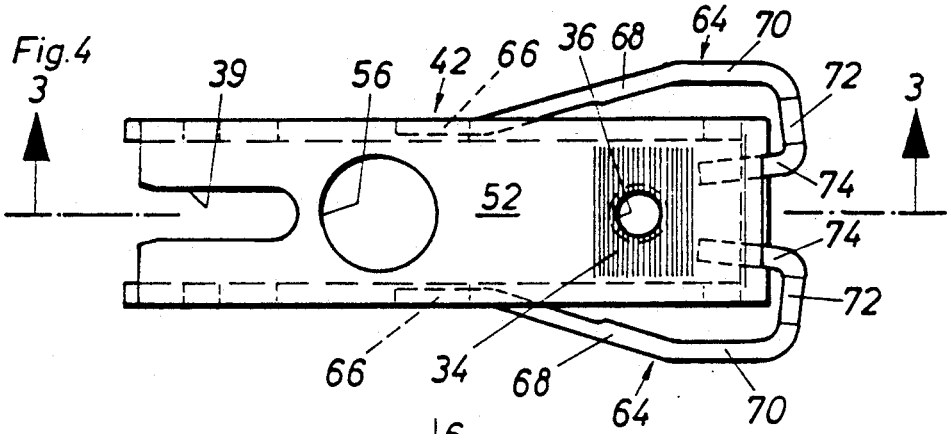
FIG. 4 is a top view of the upper mounting plate as seen in the direction of the arrow 4 in FIG. 3.

The upper mounting plate 42 represented separately in FIGS. 3 and 4 has an inverted U-shaped cross section, i.e., it is composed of an upper, elongated web 52 and flanges 54 partially straddling the sides of the bottom mounting plate 40, the open-ended slot 39 and a perforation 56 which makes it possible to loosen or tighten the fastening screw 48. In the rearward end, i.e., the end facing the interior of the cabinet, the web 52 is bent downward to form an end wall 58 in which a transversely disposed, window-like opening 60 (or two window-like openings 60 spaced-apart laterally) is provided.

A dividing slot 62 cut into the flanges 54 from the cabinet-interior end, parallel to the web 52, frees elongated strips at the rearward part of the flanges, which form the resilient bows 64, to be explained further below, which in turn are part of a catch mechanism which makes possible the releasable snap-fastening together of the rearward ends of the top and bottom mounting plates 42 and 40, respectively.

The elongated strips 64 forming the bows are therefore integrally joined at their front end to the flanges 54, having a reduced thickness in their portion at 66 directly adjacent the transition to the flanges. The stiffness of the bow 64 is thus considerably reduced in this section of the bows, i.e., the bows flex resiliently in this area when lateral pressure is applied to them. Toward the cabinet interior, the resilient portion 66 is followed in each case by a bow section 68 which is bent away from the flanges 54 and which is followed in turn by a portion that is bent back to a position approximately parallel to the longitudinal axis in which it forms a handle 70, from which again a section 72 is bent inwardly toward the longitudinal axis, and from this section a final section is bent which forms the actual catch section 74 of the resilient bow 64, this catch section 74 entering through the window-like openings in the end wall 58 into the interior of the upper mounting plate 42.

At the front end a hook 76 is formed in each flange of the upper mounting plate, and the throat of this hook slopes rearwardly at an angle, while its arch 76' is of an approximately semicircular shape.

Hooking projections 78 extending laterally from the bottom mounting plate 40 are associated with the hooks 76 and have engaging surfaces 78' of a complementary, at least approximately semicircular shape, so that it is possible to raise the rearward end of the mounting plate in the manner indicated in FIG. 2 and engage the hooks 76 of the upper mounting plate with the hooking projections 78, and then, after placing the arches 76' and 78' against one another, to rock the rearward end of the upper mounting plate 42 downwardly onto the bottom mounting plate 40. At the same time the catch sections 74 bent inwardly toward the interior of the mounting plate 52 from bows 64 enter into an opening 80 which is open at the top and rearward end and narrowed at the top by projections 82 pointing inwardly at one another. The bottoms of the flat-faced projections 82 therefore form the undercuts 84, while their top surfaces form ramps 86 which slope downwardly toward one another. When the rearward end of mounting plate 42 is rocked downwardly onto mounting plate 40, the inner ends of the catch projections 74 run onto the ramps 86 and then slide downwardly on the ramps 86 while the bows 64 are deflected, until their upper edges, upon reaching the intended catching position, pass through the gap formed between the flat-faced projections 82 and snap behind the undercuts 84; then the upper edges of the catch sections 74 lock against the associated undercuts 84, while their bottom edges rest against the bottom horizontal edge of the window-like opening 60, which serves as their abutment. Then it is no longer possible to rock the upper mounting plate 42 upwardly, unless first the catch sections 74 are pressed inwardly by exerting pressure on the bow sections 70 forming the handles, to such an extent that they come free from the undercuts 84. At the same time it is important that both catch sections 74 come free from the undercut surface 84 associated with each, which obviously requires the exertion of unlocking forces in opposite directions on the two bow sections. In practice, it is best for the person unlocking the mounting plate to do this by exerting oppositely directed pressure on the outer sides of the bow sections 70 by means of his or her thumb and index finger. As soon as the upper mounting plate is unlocked from the bottom mounting plate, i.e., the catch sections 74 are removed from the undercuts 84, the rearward end of the upper mounting plate 42 can be pulled upward with the fingers exerting the pressure, and thus the upper mounting plate 42 can be rocked upwardly. If the arm of a hinge is fastened on the upper mounting plate 42, the arm will of course also be rocked with the latter, which is possible since it is in turn pivotingly connected by its link mechanism to the door-related hinge part.

This will not result in any change, therefore, in the adjustment of the hinge arm on the upper mounting plate, so that, when the upper mounting plate is snapped back onto the lower mounting plate, the once-obtained correct alignment of the wall-related hinge part relative to mounting plate assembly 30 will be restored.

In FIGS. 9 to 11 is shown the upper mounting plate 142, and in FIGS. 12 to 14 the bottom mounting plate 140 of a second embodiment of a mounting plate assembly according to the invention, which differs partly from the mounting plate assembly 30 described above in connection with FIGS. 1 to 8 only with regard to the configuration of the snap mechanism. Therefore only the differences made in the snap-catch mechanism will be described below, because otherwise it will be sufficient, for the avoidance of repetitions, to refer to the foregoing description of mounting plate 30, inasmuch as functionally equal parts of the upper mounting plate 142 and of the bottom mounting plate 140 will be associated in drawing FIGS. 9 to 11 and 12 to 14 with the same reference numbers as the corresponding parts of the upper mounting plate 42 and bottom mounting plate 40, except for a prefixed "1."

The essential difference in the catch mechanism of this embodiment is that the sections of the resilient bows 164 which form the catch sections 174 are not bent forward into the interior of the upper mounting plate 142 from the bow sections 170 forming the handles, but that the bow sections 172 are bent inwardly at right angles ahead of the rearward end wall 158 and the catch sections 174 are then each bent in the opposite direction out of the inside of the upper mounting plate 142 through an associated window-like opening 160 in the end wall 158, i.e., they are bent with the free ends pointing into the cabinet interior. In other words, the catch sections 174 of the resilient bows 164 protrude beyond the end wall 158.

Accordingly, the bottom mounting plate 140 is longer at the cabinet-interior end than mounting plate 40, and the open-topped opening 180 whose mouth is narrowed by projections 182 is provided in the prolonged section of the bottom mounting plate extending past the rearward end of the upper mounting plate 142 into the cabinet interior. The function of the ramps 186 cooperating with the catch sections 174 and the undercuts 184 is otherwise the same as that of the ramps 86 and undercuts 84.

Figure 17:
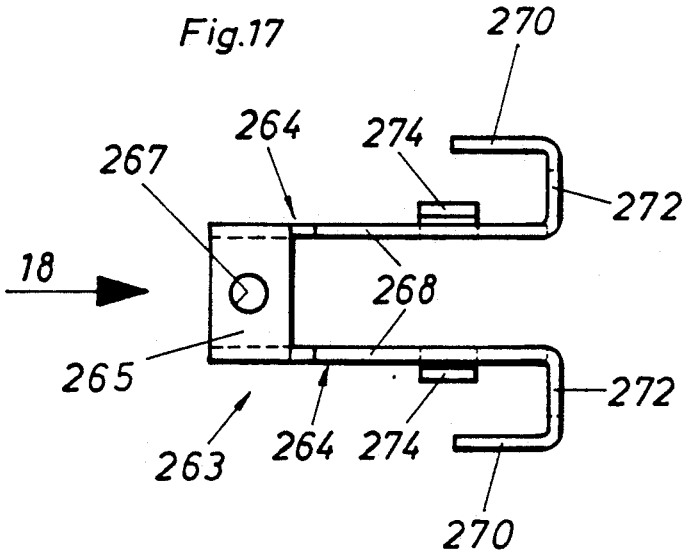
FIG. 17 is a top view of the resilient bows represented in dash-dotted lines in FIGS. 15 and 16, joined together by a bridge to form an integral component.
Figure 18:
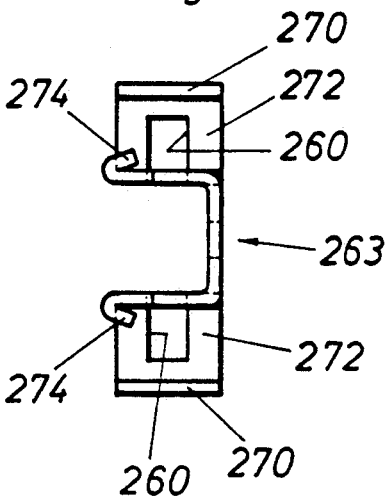
FIG. 18 is a view of the bow component, seen in the direction of arrow 18 in FIG. 17.

A third embodiment of the mounting plate assembly in accordance with the invention is shown in FIGS. 15 to 20, FIGS. 15 and 16 showing the upper mounting plate 242, FIGS. 17 and 18 a separately made bow component, and FIGS. 19 and 20 the bottom mounting plate 240. Here, again, only the differences in regard to the configuration of the catch mechanism from that of mounting plate assembly 30 will be described, while it will be sufficient to refer to the description of FIGS. 1 to 8 for the configuration identical to the latter. Functionally equal parts are again given the same reference numbers, but with a prefixed "2" in the case of this third embodiment.

The essential difference from mounting plate assembly 30 is that the resilient bows 264 provided with the catch sections 274 are in this case not integral parts of the upper mounting plate 242, but are made of spring metal on a separate bow component 263 represented separately in FIGS. 17 and 18. Its arrangement on and in the upper mounting plate 242 is represented in dash-dotted lines in FIGS. 15 and 16.

The bow component 263 is stamped from an originally flat piece of spring metal, the two resilient bows joined at their front end by a cross member 265 being bent away from the cross member at right angles to a position in which they are parallel to one another. In the cross member 265 there is punched a hole 267 which corresponds to a hole 269 in the web 252 of the upper mounting plate 242, so that the cross member can be fastened unreleasably against the inside of the web 252 by means of a rivet 271, in the manner indicated in dash-dotted lines in FIG. 15.

The catch sections 274 are formed from tabs cut on the bottom edges of bow sections 268 and bent outwardly against the bow sections 268. The bow sections 268 are of such a length that they protrude from the open end, i.e., the end not closed by an end wall, of the upper mounting plate 242. The bow sections 272 are bent outwardly from the ends of bow sections 268, and the bow sections 270 forming the handle are bent forward from their outer ends.

Instead of the window-like opening 60 in the end wall 58 of the mounting plate assembly 30, window-like openings 260 are punched into the bow sections 272, and they are entered in each case by a projection 273 extending from the vertical rear edges of the flanges 254. The height of the window-like openings 260 and of the projections 273 is again such that the projections 273 will have but little play in the vertical direction in the openings 260, while their width is selected such that the bows 264 can be bent inwardly resiliently by pressure on the bow sections 270 serving as handles to such an extent that the catch sections 274 will come free from the undercuts 284.

In FIGS. 21 to 23 and 24 to 27 the upper mounting plate 342 and bottom mounting plate 340 of an additional embodiment of a mounting plate assembly in accordance with the invention are shown which are the same in their basic construction as the first embodiment described in connection with FIGS. 1 to 8, so that in this case too, only the changes with respect to the first embodiment will be explained below, while otherwise the description of the first embodiment can be consulted. Functionally identical parts of the first embodiment and of the embodiment to be described hereinbelow in regard to its modifications, the same reference numbers being used as in the last embodiment, but with a "3" prefix.

The difference in this embodiment is that the bow sections 372 of resilient bows 365, which bear the catch sections at their inner ends, are longer than the bow sections 72 of the above mounting plate 42, and overlap as a result. So that this may be possible they have to be offset from one another in the manner shown in FIG. 22, but this, on the other hand, requires that the catch sections 374, which have been bent back at a point beyond the vertical longitudinal central plane from bow sections 372 toward the interior of the upper mounting plate 342, be jogged back again with respect to the associated spring bow 364 such that the catch sections 374 of both bows 364 will again be at the same level inside of the upper mounting plate 342.

As a result of the previously mentioned position of the particular catch section 374 of a spring bow 364 beyond the longitudinal central plane of the upper mounting plate 342, when the two bows 364 are squeezed together for the purpose of unlocking the plate from the bottom mounting plate, the two catch sections move apart. Accordingly, the catches in the bottom mounting plate 340 are so configured, in the manner best seen in FIG. 26, that the undercuts 384 and the ramps 386 are formed on rail-like projections 382 which are provided facing away from one another on a central ridge on the bottom mounting plate 340.

Again, the additional embodiment of the mounting plate in accordance with the invention that is shown in FIGS. 28 to 31 differs from the embodiment described in connection with FIGS. 2 to 8 only in the configuration of the catch mechanism, so that only these differences will be described below, while otherwise the description in relation with FIGS. 2 to 8 can be consulted, inasmuch as equal parts of the upper mounting plate 442 and of the bottom mounting plate 440 bear the same reference numbers prefixed with a "4" as the corresponding parts of the upper mounting plate 42 and bottom mounting plate 40.

The chief difference between upper mounting plate 442 and mounting plate 42 is that the bows 464 are bent and curved in the rearward end part of the mounting plate 442 to reach the side walls of the bottom mounting plate 440. When the curved bow sections 468 are squeezed together, the end sections 474 of the bow, which form the catch sections, cannot shift transversely of the longitudinal central axis of the mounting plate, but the arcuate sections 468 are bent straight, resulting in a displacement of the bow sections 470 adjoining them, and thus of bow sections 472 and 474 adjoining the latter, toward the interior of the cabinet. Furthermore, the ends of sections 470 bearing sections 472 swing slightly outward, thus also causing sections 472 with their ends bearing sections 474 to turn additionally toward the cabinet interior. This combined longitudinal displacement and turning movement suffices, however, to shift the catch sections 474 so far toward the interior of the cabinet that they come free from the associated catch 480 of the bottom mounting plate 440, and the upper mounting place 442 can accordingly be rocked upwardly in the manner described in connection with FIG. 2.

The catch 480 in the bottom mounting plate 440 is formed by a transverse groove-like indentation provided in the rearward end face. Above the catch 480 there is provided, on the rearward end of the mounting plate 440, a transversely disposed ramp 486 which, when the upper mounting plate snaps onto the bottom mounting plate, cooperates with a complementary ramp 487 (FIG. 28) on catch section 474, in order to permit the longitudinal movement of the catch section necessary for snapping into the groove-like indentation 480 by wedging action.

The embodiment shown in FIGS. 32 to 36 resembles more closely the embodiment in FIGS. 2 to 8, so that the explanations of the configuration of the upper mounting plate 542 and of the bottom mounting plate 540 can be abbreviated, and otherwise reference is again made to the description of FIGS. 2 to 8. Equal parts are again associated in the drawing with the same references prefixed with a "5."

The essential difference between the upper mounting plate 542 and mounting plate 42 lies virtually only in the form of the bows 564 and in the arrangement of the ramp surface 587 on the catch sections 574. Since the catch sections 574, unlike the catch sections 74 of bow 64 of the upper mounting plate 42, do not undergo any displacement at right angles to the longitudinal central axis when the upper mounting plate 542 is snapped onto the bottom mounting plate 540—and to this extent they are comparable to the embodiment previously described in connection with FIGS. 28 to 31—but undergo a displacement substantially parallel to the longitudinal axis, the ramp surface 587 is disposed in the manner seen in FIG. 32, and it cooperates with the ramp surface 586 on the bottom mounting plate 540 when the attachment is made in the desired manner.

A transverse displacement exerted on the bow sections 570 in the transverse direction and transferring itself to the catch sections 574 is provided for the release. The slot 581 running at the rearward end of the upper side of the upper mounting plate 540 to the transverse recesses forming the catch opening 580 allows the catch sections 574 to pass through it for the purpose of release.

Lastly, in FIGS. 37 to 39 there is shown one more embodiment of the mounting plate according to the invention, which serves for mounting a hinge on the cabinet wall. Of this hinge only the wall-related part of the hinge is shown in the drawings, this part being in the known form of an elongated arm 10 of channel-like cross section. In its front end pointing out of the interior of the cabinet to which the hinge is to be fastened, the arm has two pivot holes 14 and 16 in which the ends of pivot pins, not shown, are riveted, which form the pivots at the cabinet wall end for two hinge links whose other ends are pivoted in the corresponding door-related hinge part, which is to be understood to be a conventional cup fastened in a mortise in the door. The arm 10 represented by way of example thus is part of a conventional four-pivot hinge, which is not shown, but it is to be noted that the mounting plate itself is also usable for hinges having linkage mechanisms of different configuration. An adjusting screw 22 is provided in a tap 18 in the web 20 of the arm 10, and has a head 26 connected to it by a neck 24 of reduced diameter and situated between the flanges 12. This adjusting screw on the one hand secures the arm, which is provided with an open-ended slot 28 on its rearward end, against lifting away from the mounting plate assembly, identified in its entirety by the number 630, and on the other hand permits the distance of the arm from the mounting plate 630 to be varied by turning the adjusting screw in or out.

The mounting plate 630 has an elongated mounting section 632 at whose rearward end, i.e., the end pointing toward the cabinet interior, a tap 636 is provided within an area provided with transverse serrations 634. Into this tap the shaft of a set screw 638 serving for mounting the hinge arm can be driven through the slot 28 in the arm 10. When the set screw 638 is tightened, its head presses the cabinet-interior end of the web 20, which is likewise provided with transverse serrations, against the transverse serrations 634, and thus secures the arm 10 against longitudinal displacement on mounting plate 630. Loosening the set screw 638, however, permits longitudinal displacement. In the front end portion, i.e., the one pointing out from the cabinet interior, the mounting section 632 has a slot 639 open in the front end face of the mounting plate to accommodate the neck 24 of the adjusting screw 22 for the adjustment of the door overlap.

The actual mounting plate assembly 630 is bipartite, and is composed of a bottom mounting plate 640 to be fastened directly to the cabinet wall (FIGS. 42 and 43) and an upper mounting plate 642 snap-fastened onto the bottom mounting plate 640 (FIGS. 40 and 41). In the embodiment represented the mounting plate 630 is a so-called wing plate in which a wing 644 (FIG. 43) projects on opposite sides from the mounting section 632 serving for the adjustable attachment of a corresponding hinge arm 10, and is commonly used to fasten the mounting plate assembly to the cabinet wall. The upper mounting plate 642 is placed on the bottom mounting plate 640 and snap-fastened thereto in the manner to be described below. The wings 644 are the outer end sections of a separately made, integral fastening plate lying in a matching recess in the bottom of the bottom mounting plate 640 and screwed to the latter. To fasten the mounting plate 630 on a cabinet wall, wood screws (not shown) are driven through countersunk openings 646 (FIG. 43) in the wings 644 into holes in the cabinet. The wing plate or fastening plate formed by the wings 644 and the bottom mounting plate 640 are in turn fastened together by a screw 648 (FIG. 42) whose shaft is driven through a slot 650 (FIG. 43) running transversely of the length of the mounting plate into a tap 651 (FIG. 42) in the fastening plate. When the screw 648 is loosened, therefore, a certain movement of the bottom mounting plate 640 relative to the fastening plate is possible, which is limited by the length of the slot 650, i.e., an adjustment of the height of a hinge mounted on the mounting plate 630 is possible.

The upper mounting plate 642 separately shown in FIGS. 40 and 41 has a U-shaped cross section, i.e., it is composed of an upper, elongated web 652 and flanges 654 extending downwardly from its longitudinal margins and partially straddling the sides of the bottom mounting plate 640, the slot 639 being provided in the web 652 and an opening 656 which permits the loosening and tightening of the screw 648.

In the rearward end portion, i.e., the one pointing toward the cabinet interior, the web 652 is bent downward to form an end wall 658 in which a transversely disposed, window-like opening 660 is provided.

By means of a cut or slot 662 made in the flanges 654 from the cabinet-interior end, parallel to the web 652, strap-like sections are created in the rearward areas of the flanges, which form the spring bows 664, to be further explained hereinbelow, which in turn are part of a catch mechanism which permits the releasable fastening together of the rearward end of the top and bottom mounting plates.

The strap-like sections 664 forming the bows are thus integral at their front end with the flanges 654, and they may have a reduced thickness in the immediate transitional area. The flexibility of the bows 664 is thus considerably reduced in this transitional area, i.e., the bows flex resiliently when pressure is applied laterally in this area. The transitional area 666 is followed by a bow section 668 bent outwardly at an angle toward the cabinet interior, followed by a bow section 670 bent approximately parallel to the longitudinal axis and forming a handle, from which another bow section 672 is bent inwardly toward the longitudinal central axis, and from this lastly a final bow section forming the actual catch section 674 of the resilient bow 664 is bent back again so that these bow or catch sections 674 enter through the window-like opening 660 in the rearward end wall 658 into the interior of the upper mounting plate 642. The free end of the actual catch sections 674, unlike the previously described mounting plate, is not cut off at right angles but has the arcuate engaging section 676 which can be seen especially in FIGS. 37 to 39 and 40, and which, in the manner to be described below, cooperates with a complementary arcuate catch section in the bottom mounting plate 640. In the front end of the upper mounting plate 642, oppositely directed bows 664' are formed corresponding to the bows 664 previously described. Since these bows 664', with the exception of their mirror-image relationship about a plane running approximately centrally across the mounting plate 642, are configured in the same manner as the bows 664' and the sections forming them are identified in the drawing by the same reference numbers with a suffix "'", these bows 664 do not yet have to be described in detail, and it will suffice to consult the description given above.

A notch 679 is made in the approximate center of the bottom edge of the side flanges of the upper mounting plate 642, and tapers upwardly, i.e., toward the web 652.

The bottom mounting plate 640 has in its rearward, i.e., cabinet-interior end an indentation 680 open at the top as well as the rearward end face, into which the catch sections 674 of the bow 664 can enter and hold the mounting plate 64 in the proper position in which it is joined to the bottom mounting plate 640. The indentation 680 is narrowed at the top by projections directed inwardly toward one another. At the bottom, therefore, the rail-like projections form undercuts 684, but, unlike the configuration of the previously described mounting plate, they are not flat but of an arcuate shape to complement the engaging sections 676 on the catch sections 674. The upper surfaces of the rail-like projections are configured as ramps 686 tapering downwardly at an angle. When the rearward end of the mounting plate 642 is pressed down onto the mounting plate 640, the inner ends of the catch sections 674 run onto the ramps 686 and then slide, with resilient deformation of both bows 664, down on the ramp surfaces 686 until their upper margins, upon reaching the proper catch position, pass beyond the narrow gap formed between the projections and snap behind the undercuts 684. Then the engaging surfaces 676 on the catch sections 674 are locked on the associated, matching arcuate undercut 684, while its bottom edge is supported on the bottom horizontal edge of the window-like opening 660 as an abutment. It is then no longer possible to lift the upper mounting plate 642 unless first the catch sections 674 are forced inwardly by exerting a pressure on the bow sections 670 forming the handles to such an extent that they come free from the undercuts 684. At the same time it is important that the two catch sections 674 come free from their associated undercuts 684, which evidently calls for the application of oppositely directed unlocking forces on the two bow sections 670. In practice this is best accomplished when the operator exerts oppositely directed pressure on the outside of the bow sections 670 with the thumb and index finger.

At its front end, i.e., the end pointing out from the cabinet interior, the bottom mounting plate is again provided with a recess 680' corresponding to the recess 680. Since otherwise the configuration of the recess 680' is the same as recess 680, what was said above in regard to the catching of the catch sections 674 on the undercuts 684 applies also to catch sections 674' and their catching on the undercuts 684'. It is now clear that the upper mounting plate 642, together with the hinge arm 10 held by it, is released from the bottom mounting plate in the manner represented in FIG. 38 by simultaneously squeezing together the bow sections 670 and 67' serving as handles, until the catch sections 674, 674', are unlocked from the undercuts 684, 684', and then, while continuing to squeeze together bow sections 670, 670', pulling the bows away from the bottom mounting plate 40.

On account of the complementary arcuate configuration of the engaging sections 676, 676', and of the undercuts 684, 684', it is also possible, on the other hand, to unlock the top and bottom mounting plate 642, 640, at only one end, and then to raise this end up and pull the still-engaged catch sections 674', 674, horizontally out of the corresponding recess 680', 680. In FIG. 37, this is represented in the form in which the unlocking at the rearward end is accomplished by disengaging the catch sections 674 from the undercuts 684 and raising up the rearward end of the upper mounting plate 642, whereupon the upper mounting plate 642 can be pulled forward, i.e., leftward in FIG. 37, thus drawing the catch sections 674' out of the recess 680'. This manner of separating the mounting plates 642 and 640 corresponds therefore to the procedure used with the mounting plates described before, while the catch section 674' with engaging surface 676' will then correspond functionally to the hook and the undercut 684' to the hook projection.

FIG. 39 then also shows the likewise possible unlocking by releasing and raising up the front end of the upper mounting plate followed by pushing this upper mounting plate 642 toward the cabinet interior. Obviously this possibility can be selected only if a hinge mounted on the upper mounting plate is not yet carrying a door, since the door would prevent the shifting of the upper mounting plate 642 toward the cabinet interior.

It is to be noted in any case that no change will occur in the adjustment of a hinge arm held on the upper mounting plate when the two mounting plates are separated from one another, so that, when the upper mounting plate has been snapped back onto the lower mounting plate the previously located correct alignment of the hinge arm 10 relative to the mounting plate assembly 630 will be regained.

In order to keep the upper and lower mounting plate joined together in correct longitudinal alignment with one another, a projection 688 is provided on each lateral surface of the bottom mounting plate and mates with the notches 679 in the flanges 654 of the upper mounting plate when the two mounting plates are joined together.

It is apparent that modifications and further developments of the above-described embodiments can be made within the scope of the invention, both in regard to the configuration and in regard to the arrangement of the spring bows and the engagement of their catch sections in the corresponding catches in the bottom mounting plate. It is essential only that the catch mechanism consist of two resilient bows provided in mirror image symmetry about the longitudinal central axis of the mounting plate assembly, and having catch sections and corresponding catch recesses likewise in mirror-image symmetry in the bottom mounting plate, and that the snap attachment and release be possible only by exerting oppositely directed pressure simultaneously on both bows in a direction parallel with the surface of the cabinet.

I claim:

1. A mounting plate assembly for an adjustable mounting of a wall-related part of a cabinet hinge having a carcase-related part, the assembly being composed of two separable mounting plates, a bottom mounting plate nearer the wall is fastenable permanently to the wall, and an upper mounting plate more remote from the wall for adjustably holding the carcase-related part of the hinge, a resilient catch mechanism for fastening the upper mounting plate to the bottom mounting plate, the bottom mounting plate having a front end area facing a door, said front end area of said bottom mounting plate having at least one hook projection, said upper mounting plate having a bottom on which is located a hook receptacle with which said hook projection is associated, said hook projection and said hook receptable having associated engagement surfaces complementary to each other and at least sectionally approximately acute, and said resilient catch mechanism being provided with a handle for releasing snap-fastening between the mounting plates, comprising said upper mounting plate including an end portion pointing toward an interior of a cabinet wherein at least said end portion pointing toward the interior of the cabinet partially covers said bottom mounting plate, said end portion including two bows which are resiliently flexible and parallel to a surface of the wall, each of said bows having a catch section, said bottom mounting plate having catch recesses associated with and matingly locked with each said catch section, said catch sections and said catch recesses being disengageable by pinching said bows together parallel to said surface of said wall; each bow having a handle accessible for applying pressure directed against one another parallel to the surface of said wall when said two mounting plates are in a snapped-together position.

2. A mounting plate assembly according to claim 1, wherein the upper mounting plate has an inverted U-shaped cross section with an upper, elongated web surface and has flanges along its opposite longitudinal margins at least partially covering sides of the bottom mounting plate, and the two resilient bows each have a front end pointing away from the carcase interior which are each fastened t the upper mounting plate and have a resilient area which is offset toward the interior of the carcase forming the handles, and projecting at least sectionally beyond the boundary of the upper mounting plate, and between confronting inside surfaces of the resilient bows and the surfaces of the mounting plates facing them a gap is defined therein which permits horizontal deflection of the bows against one another by an amount necessary for the release.

3. A mounting plate assembly according to claim 2, wherein the resilient bows are of elongated strap-like sections of spring metal joined to the upper mounting plate.

4. A mounting plate assembly according to claim 2, wherein the resilient bows are integral, strap-like sections cut free from the material of the upper mounting plate.

5. A mounting plate assembly according to claim 4, wherein the resilient bows have a portion having a reduced thickness, said portion directly adjoining the area of transition to the upper mounting plate.

6. A mounting plate assembly according to claims 2, 4, or 5, wherein the resilient bows are formed by cuts brought from the carcase-interior end of the lateral flanges of the upper mounting plate.

7. A mounting plate assembly according to any one of claims 2, 3, 4 or 5, wherein the catch recesses provided in the bottom mounting plate have openings open at an upper side facing the upper mounting plate for introduction of the catch sections provided on the resilient bows, the introduction openings and/or the catch sections are each provided with at least one ramp surface forcing the resiliently associated catch section into the release direction when introduced and, and undercut, following in the direction of introduction, behind which the catch sections spring back together when the two mounting plates reach a proper point of engagement.

8. A mounting plate assembly according to any one of claims 2, 3, 4, or 5, wherein the resilient bows each have an area of fastening and are each divided beginning at said area of fastening where they are the upper mounting plate or at an area of transition into the associated lateral flange of the upper mounting plate, into a plurality of sections running at angles to one another, the first of which is bent outwardly at an angle in a direction toward the cabinet-interior end of the mounting plate, an adjoining bow section back to a position disposed approximately parallel to the mounting plate's longitudinal central axis, and a following bow section then is bent at approximately right angles to the longitudinal central axis, and a next end section forming an actual catch section being bent back to a position approximately parallel to the longitudinal central axis.

9. A mounting plate assembly according to claim 8, wherein the bow sections forming the catch section are bent back from the bow sections, bent at approximate right angles to the longitudinal central axis, toward the cabinet-exterior end of the mounting plate assembly.

10. A mounting plate assembly according to claim 8, wherein the bow sections forming the catch section are bent from the bow sections, which are bent at approximate right angles to a long axis, toward the cabinet-interior end of the mounting plate.

11. A mounting plate assembly according to any of claims 2, 3, 4 or 5, wherein said upper mounting plate has a window-like opening and the resilient bows in the vicinity of the catch section are guided through said window-like opening in a wall of the upper mounting plate which overlaps the end wall of the bottom mounting plate, said end wall having a free height measured at right angles to the wall surface which is approximately equal to or only slightly greater than the height of the bow in a portion passing through the opening, while its free width, measured in a direction in which the bow is moved when it releases, is dimensioned according to an amount of bow movement necessary for the release.

12. A mounting plate assembly according to claim 3, wherein the resilient bows are disposed within the flanges of the upper mounting plate and are brought out of its cabinet-interior end, the catch sections being formed by projections provided in an area lying within the upper mounting plate said projections being bent outwardly and being caught each on an undercut of the bottom mounting plate, the end sections of the bows which are brought out of the cabinet-interior end being bent once at about right angles in opposite directions away from one another and then again bent forward at about right angles thereby forming said handles, and said sections being bent to point away from one another, a window-like opening is provided through which a projection enters, said projection extending into the cabinet interior from the flanges of the upper mounting plate, the window-like opening being about equal in height or only slightly higher than the height of the associated flange projection, and having a width dimensioned according to an amount of bow movement required for the release.

13. A mounting plate assembly according to claim 12, wherein the two resilient bows are bent at right angles in their end areas lying outside of the cabinet within the upper mounting plate away from a cross member joining them integrally, and that the cross member is fastened to the inside of the web of the upper mounting plate.

14. A mounting plate assembly according to claim 13, wherein a cross member is riveted against an inside of the web.

15. A mounting plate assembly according to claim 9, wherein the bow sections bearing the backwardly bent catch sections are offset in h eight from one another and are sufficiently long to overlap one another in a direction of their length, and said catch sections are jogged back each contrariwise with respect to the bow sections bearing them by such an amount vertically that they are at the same level inside of the upper mounting plate.

16. A mounting plate assembly according to claims 2, 3, 4, or 5, wherein the catch recesses are formed by a groove-like recess running parallel to the cabinet wall surface and across the longitudinal central axis of the mounting plate in the rearward end wall facing the cabinet interior of the bottom mounting plate, and the resilient bows extend beyond the rear wall of the bottom mounting plate into the cabinet interior and are bent back to the bottom mounting plate so that in the snap-fastening position their free end sections forming the catch sections engage the groove-like recess of the bottom mounting plate.

17. A mounting plate assembly according to claim 16, wherein the bottom mounting plate is provided at its cabinet-interior end, on the upper side facing the upper mounting plate, above the slot-like recess, with a ramp surface, said ramp surface running transversely of the longitudinal central axis and onto which the catch sections run when the upper mounting plate is snapped onto the bottom mounting plate and are pushed resiliently inward toward the cabinet interior to such an extent that their free ends pass beyond the rearward end wall of the bottom mounting plate until snapping back into the groove-like recess.

18. A mounting plate assembly according to claim 2 wherein the resilient bows are bent back in an area of the cabinet-interior end against the bottom mounting plate and having an adjoining section supported on the associated side wall of the bottom mounting plate and extending to a point behind the rearward end wall of the bottom mounting plate, from which again the end section forming the catch section is bent back toward the groove-like recess in the end wall.

19. A mounting plate assembly according to claim 2, wherein the resilient bows have sections diverging from the area in which they are fastened to the upper mounting plate, backwardly at an angle into the cabinet interior and sections extending beyond the rearward end wall of the bottom mounting plate into the interior of the cabinet, which are followed in each case by a bow section which is bent backward and carried behind the end wall, which is followed by end sections forming the catch sections in a parallel spaced relationship, and in that approximately in the center of the cabinet-interior end of the bottom mounting plate an opening facing the cabinet interior and running from the top to the groove-like recess is provided having a width measured across the longitudinal central axis which is smaller than the lateral spacing of the catch sections from one another, but is at least slightly greater than twice the material thickness of the catch sections.

20. A mounting plate assembly according to claim 17, wherein the end sections forming the catch sections of the bows, which come in contact in the area when the upper mounting plate is snapped onto the bottom mounting plate are provided with a ramp surface which is complementary to the ramp surface of the bottom mounting plate.

21. A mounting plate assembly according to claim 16, wherein the resilient bows are carried int eh vicinity of the catch section through a window-like opening in a wall of the upper mounting plate overlapping the end wall of the bottom mounting plate, the free height of the opening being equal to or only slightly greater than the height of the bows in the area passing through the opening, while the width of the opening measured in the direction of actuation of the bows in releasing is at least so great that the bow sections passing through the opening can perform the lateral movements parallel to the cabinet wall that are necessary in releasing.

22. A mounting plate assembly according to claim 1, wherein two hook projections each forming an additional catch recess (undercut 684') are provided on a front end of the door of the bottom mounting plate, the associated hook recesses of the upper mounting plate are each formed by additional bows resiliently flexible and parallel to the cabinet wall surface, each having a catch section matingly caught in its associated catch recess, the catch sections and the catch recesses being adapted to be brought out of engagement by flexing the additional bows against one another parallel to the cabinet wall, and each bow having an additional handle which in an assembled position of the two mounting plates is accessible for an exertion of a pressure directed against one another parallel to the cabinet.

23. A mounting plate assembly according to claim 22, wherein the catch sections formed on the bows are provided at the cabinet-interior end of the mounting plate assembly, and the corresponding catch recesses, are in a mirror-image relationship, with respect to a plane running parallel to the hinge pivot axis and perpendicular to the cabinet wall, approximately through the center of the mounting plate assembly, to the additional catch sections formed on the bows provided at the front, door end, and to the associated additional catch recesses.

24. A mounting plate assembly according to claim 22, wherein the upper mounting plate, with respect transversely to its length, has an inverted U-shaped cross section forming downwardly pointing limbs, and straddles the lateral surfaces of the bottom mounting plate with its lateral walls formed by said downwardly pointing limbs, and a cutout is provided, said cutout being opened in a free margin of the respective one of said lateral walls, which is matingly engaged by a projection reaching out from the lateral surfaces of the bottom mounting plate.

25. A mounting plate assembly according to claim 24, wherein the cutouts expand in a direction of the free margin of each of the laterial walls, and that the projections have a shape which expands in a complementary manner.

26. A mounting plate assembly according to claim 223, wherein the bottom mounting plate is divided into a holder which snap-fastens the upper mounting plate, and a fastening plate adapted to be fastened on the cabinet wall, and the holder is displaceable parallel to the hinge pivot axis and is adapted to be locked on the fastening plate at selectable displacement positions.

27. A mounting plate assembly according to claim 26, wherein the fastening plate has two wing-like projections extending in opposite directions from the opposite longitudinal margins of the holder, wherein for each of said projections a fastening bore is provided to accommodate the shaft of a fastening screw.

28. A mounting plate assembly according to claim 26, wherein the fastening bores in the wing-like projections have a spacing corresponding to the spacing of rows of bores provided in the walls of the cabinet to accommodate shelves or the like.

* * * * *

UNITED STATES PATENT AND TRADEMARK OFFICE

CERTIFICATE OF CORRECTION

PATENT NO. : 5,085,491

DATED : February 4, 1992

INVENTOR(S) : Karl Lautenschläger

It is certified that error appears in the above-identified patent and that said Letters Patent is hereby corrected as shown below:

On the Title page, item[86] PCT No. : PCT/EP88/01044
§ 371 Date: Jun. 29, 1989
§ 102(e) Date: Jun. 29, 1989

Signed and Sealed this

Twenty-fifth Day of May, 1993

Michael K. Kirk

MICHAEL K. KIRK

*Acting Commissioner of Patents and Trademarks*

*Attest:*

*Attesting Officer*